US011970299B2

(12) United States Patent
Boldrini

(10) Patent No.: US 11,970,299 B2
(45) Date of Patent: Apr. 30, 2024

(54) DEVICE AND METHOD FOR FILLING CONTAINERS FOR BAGS OF SMOKELESS TOBACCO

(71) Applicant: G.D S.p.A., Bologna (IT)

(72) Inventor: Fulvio Boldrini, Bologna (IT)

(73) Assignee: G.D S.P.A., Bologna (IT)

( * ) Notice: Subject to any disclaimer, the term of this patent is extended or adjusted under 35 U.S.C. 154(b) by 0 days.

(21) Appl. No.: 17/792,983

(22) PCT Filed: Feb. 8, 2021

(86) PCT No.: PCT/IB2021/050997
§ 371 (c)(1),
(2) Date: Jul. 14, 2022

(87) PCT Pub. No.: WO2021/165782
PCT Pub. Date: Aug. 26, 2021

(65) Prior Publication Data

US 2023/0046205 A1 Feb. 16, 2023

(30) Foreign Application Priority Data

Feb. 20, 2020 (IT) ..... 102020000003476

(51) Int. Cl.
*B65B 29/00* (2006.01)
*B65B 35/28* (2006.01)
(Continued)

(52) U.S. Cl.
CPC ..... *B65B 29/00* (2013.01); *B65B 35/28* (2013.01); *B65B 39/007* (2013.01); *B65B 39/12* (2013.01); *B65B 43/50* (2013.01); *B65B 5/06* (2013.01)

(58) Field of Classification Search
CPC ..... B65B 29/00; B65B 29/02; B65B 35/10; B65B 35/26; B65B 35/28; B65B 2230/02;
(Continued)

(56) References Cited

U.S. PATENT DOCUMENTS 3,951,399 A * 4/1976 Reist ..... B65H 5/302 271/295
4,265,073 A * 5/1981 Seragnoli ..... B65B 35/26 53/542
(Continued)

FOREIGN PATENT DOCUMENTS

EP 2457834 A1 5/2012
EP 3321194 A1 5/2018

OTHER PUBLICATIONS

International Search Report dated Apr. 13, 2021 from counterpart PCT App No. PCT/IB2021/050997.

*Primary Examiner* — Joshua G Kotis
(74) *Attorney, Agent, or Firm* — SHUTTLEWORTH & INGERSOLL, PLC; Timothy J. Klima

(57) ABSTRACT

A device for filling containers for bags of smokeless tobacco, includes an infeed station for feeding a succession of inner frames, a filling station to feed a succession of individual bags tobacco to a respective inner frame, a release station for releasing inner frames full of bags, a conveyor defining a feed line which passes through the infeed station, the filling station and the release station and which has a housing to hold and move a respective inner frame from the infeed station to the release station via the filling station. A suction device is disposed in the filling station to apply suction in the housing of the conveyor disposed in the filling station and a rotation device is disposed in the filling station and confronting the housing. The rotation device rotates the
(Continued)

inner frame in the housing so successive radial compartments of the inner frame confront respective bags.

25 Claims, 4 Drawing Sheets

(51) Int. Cl.

| | |
|---|---|
| ***B65B 39/00*** | (2006.01) |
| ***B65B 39/12*** | (2006.01) |
| ***B65B 43/50*** | (2006.01) |
| *B65B 5/06* | (2006.01) |

(58) Field of Classification Search
CPC ..... B65B 39/007; B65B 39/12; B65B 5/06; B65B 5/061; B65B 43/50; B65B 43/56; B65B 43/60; B65B 43/62
See application file for complete search history.

(56) References Cited

U.S. PATENT DOCUMENTS

| | | | | |
|---|---|---|---|---|
| 6,925,784 | B2 * | 8/2005 | Escobar | B65B 59/001 53/531 |
| D637,903 | S * | 5/2011 | Ghiotti | D9/756 |
| D683,497 | S * | 5/2013 | Ghiotti | D9/428 |
| 8,663,723 | B2 * | 3/2014 | Borkiewicz | B65B 25/04 53/247 |
| 9,487,313 | B2 * | 11/2016 | Aspgren | B65B 35/28 |
| 9,527,611 | B2 * | 12/2016 | Lofman | B65B 35/28 |
| 11,046,464 | B2 * | 6/2021 | Söderström | B65B 39/007 |
| 11,383,867 | B2 * | 7/2022 | Berger | B65B 35/26 |
| 2012/0000164 | A1 * | 1/2012 | Boldrini | B65B 29/00 53/148 |
| 2013/0232922 | A1 * | 9/2013 | Aspgren | B65B 5/06 53/235 |
| 2013/0239517 | A1 * | 9/2013 | Lofman | B65B 35/40 53/235 |

* cited by examiner

DEVICE AND METHOD FOR FILLING CONTAINERS FOR BAGS OF SMOKELESS TOBACCO

This application is the National Phase of International Application PCT/162021/050997 filed Feb. 8, 2021 which designated the U.S.

This application claims priority to Italian Patent Application No. 102020000003476 filed Feb. 20, 2020, which application is incorporated by reference herein.

TECHNICAL FIELD

This invention addresses the field of containers for bags of smokeless tobacco.

More specifically, this invention relates to a device and a method for filling containers for bags of smokeless tobacco, specifically tobacco of the snus type.

BACKGROUND ART

Generally speaking, containers for tobacco bags have a parallelepiped or cylindrical shape and comprise a body (provided with lid) and an inner frame comprising radial separators defining a plurality of radial compartments containing the bags.

The bags are substantially pillow-shaped, elongated along a longitudinal axis and the wrapping material used is soft and, usually, permeable to liquids.

The aforementioned containers are made and sized to prevent damage to the bags they contain.

Despite this, inserting the bags into the containers constitutes a critical step in the life of the bags. For example, during insertion of the bags into the radial compartments, impact with the inner frame may result in the bags being damaged. Owing to the particular shape of the radial separator, the impact with the separator may cause the bag to tear (and open), allowing its contents to spill out into the container body. Moreover, if the bag is not correctly inserted into its respective radial compartment, it may be crushed when the container body is closed. In such situations, therefore, the bag may break open and/or stain the other bags (or the inside surfaces of the container body and inner frame) leading to economic loss and deterioration in the overall quality of the product.

To overcome these drawbacks, machines and methods have been specifically designed to increase the precision of inserting the bags. Disadvantageously, these solutions have led to a general reduction in production speed and, consequently, to economic loss in terms of the time scale for the production of a single container.

Aim of the Invention

In this context, the technical purpose which forms the basis of this invention is to propose a device and a method for filling containers for bags of smokeless tobacco to overcome the above mentioned drawbacks of the prior art.

More specifically, the aim of this invention is to provide a device and a method for filling containers for bags of smokeless tobacco to allow the containers to be filled quickly and precisely.

A further aim of this invention is to provide a device and a method for filling containers for bags of smokeless tobacco to prevent damage to the bags so the tobacco does not spill out into the containers.

The technical purpose and aims specified are substantially achieved by a device for filling containers for bags of smokeless tobacco comprising the technical features set forth herein and by a method for filling containers for bags of smokeless tobacco comprising the technical features set forth herein.

This disclosure accordingly describes a device for filling containers for bags of smokeless tobacco, specifically tobacco of the snus type. Each container comprises a body and an inner frame comprising radial separators that define a plurality of radial compartments. The device comprises an infeed station configured for feeding at least one succession of inner frames, wherein each inner frame has a central portion which extends around a respective central axis and a plurality of radial separators extending away from the central portion and defining a plurality of radial compartments which are angularly disposed around the central axis. The device also comprises a filling station configured to feed a succession of individual bags of smokeless tobacco to a respective inner frame and a release station configured for releasing at least one succession of inner frames which are full of bags. The device also comprises a conveyor defining a feed line which passes through the infeed station, the filling station and the release station and which has at least one housing configured to hold and move a respective inner frame from the infeed station to the release station by way of the filling station. The device also comprises suction means, disposed in the filling station and configured for applying pneumatic suction in the housing of the conveyor disposed in the filling station, and rotation means, disposed in the filling station and confronting the housing of the conveyor disposed in the filling station. The rotation means are configured to set the inner frame disposed in the housing in rotation about the respective central axis so that successive radial compartments of the inner frame each confront a respective bag to be inserted in sequence.

Preferably, the infeed station is configured to feed a succession of pairs defined by an inner frame and a corresponding container body in such a way that each inner frame and each corresponding container body are made to advance in parallel along respective trajectories running alongside each other. The conveyor is configured for advancing each inner frame and each corresponding container body along the feed line while keeping them in a mutually juxtaposed configuration at least until they reach the filling station.

The device preferably also comprises packing means, disposed in the release station or just upstream of the release station and configured to insert each inner frame, which is full of respective bags, into the corresponding container body.

Advantageously, the combined action of the suction means and of the rotation means allows the radial compartments defined by the radial separators of the inner frame to be filled quickly and precisely.

Another advantage of the solution proposed is that the rotation means are configured for rotating through a predetermined angle to allow the radial compartment to precisely confront a filling opening of the filling station.

This disclosure also describes a method for filling containers for bags of smokeless tobacco, specifically tobacco of the snus type, implemented by a device such as that described above. The method comprises the steps of feeding a succession of bags in proximity to the filling station, feeding a succession of inner frames into the infeed station, inserting an inner frame into a housing of a conveyor, moving the housing provided with the inner frame along a feed line from the infeed station to the filling station, applying pneumatic suction in the housing of the conveyor through suction means disposed in the filling station, so as to fill a radial compartment of the inner frame with a bag, through the rotation means, rotating the inner frame disposed in the housing about the respective central axis so that an empty radial compartment of the inner frame confronts a respective bag to be inserted, repeating the steps of applying the pneumatic suction and of rotating until the radial compartments of the inner frame are all full, moving the housing, with a full inner frame in it, up to the release station and releasing the inner frame which is full of bags.

Preferably, the method also comprises the steps of feeding a succession of container bodies defining a succession of pairs defined by an inner frame and a corresponding container body, inserting a container body into a respective housing of a conveyor, moving the housing provided with the container body along a feed line from the infeed station to a release station while keeping each inner frame and each corresponding container body in a mutually juxtaposed configuration at least until they reach the filling station and inserting each inner frame, which is full of respective bags, into the corresponding container body through packing means disposed in the release station.

Preferably, the step of feeding the succession of bags is carried out by a feed conveyor, specifically a band conveyor, configured to feed a succession of individual bags spaced from each other by a predetermined spacing so they confront the filling station.

The dependent claims, which are incorporated herein by reference, correspond to different embodiments of the invention.

BRIEF DESCRIPTION OF THE DRAWINGS

Further features and advantages of the invention are more apparent in the non-limiting description which follows of a preferred but non-exclusive embodiment of a device and a method for filling containers for bags of smokeless tobacco as illustrated in the accompanying drawings, in which.

DETAILED DESCRIPTION OF PREFERRED EMBODIMENTS OF THE INVENTION

Figure 1:
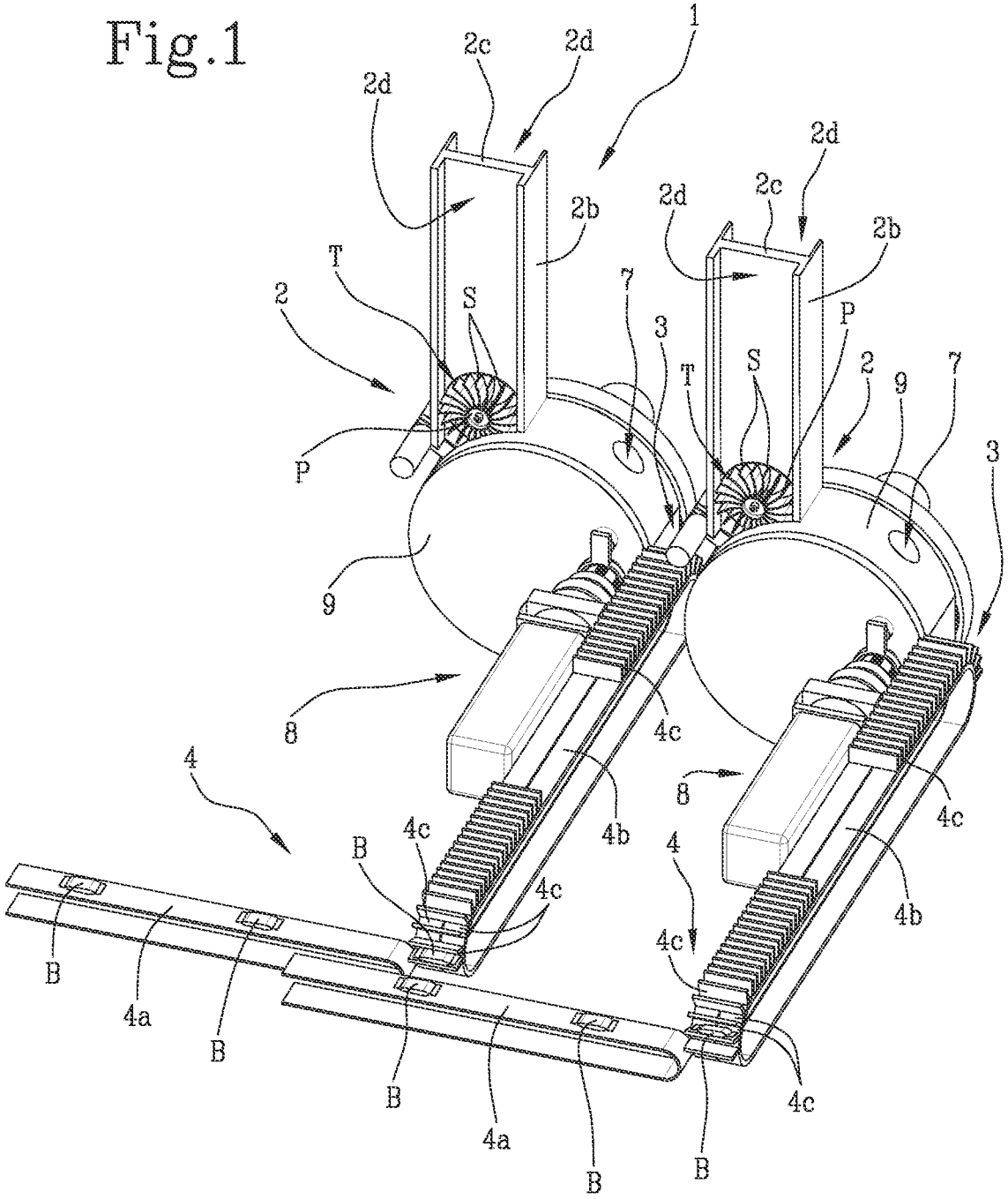
FIG. 1 is a perspective view of a device of this invention.

With reference to the accompanying drawings, the numeral 1 denotes in its entirety a device for filling containers for bags of smokeless tobacco, specifically tobacco of the snus type, and which for simplicity of description will hereinafter be referred to simply as "device 1". The accompanying drawings, and FIG. 1 in particular, show two devices 1 defining working lines of a plant for the production of the aforementioned containers.

The bags B are substantially pillow-shaped, elongated along a longitudinal axis and the wrapping material used is soft and, usually, permeable to liquids.

Each container comprises a body C and an inner frame T comprising radial separators S that define a plurality of radial compartments. The inner frame T is thus shaped in such a way as to define the above mentioned radial compartments for containing the bags B inside the body of the container.

Each inner frame T has a central portion P which extends around a respective central axis. The plurality of radial separators S extends away from the central portion and defines the above mentioned plurality of radial compartments, which are angularly disposed around the central axis. The number of radial separators S determines the number of radial compartments, hence the capacity of the container, expressed in bags B insertable therein.

The device 1 comprises an infeed station 2 configured for feeding at least one succession of inner frames T. In other words, the infeed station 2 is configured for continuously feeding the inner frames T to the device 1, preferably intermittently.

The device 1 is also provided with a filling station 3 configured for feeding a succession of individual bags B. More specifically, the filling station 3 is configured to feed the bags B to a respective inner frame T.

As shown, for example, in the accompanying drawings, the device 1 may also comprise a feed conveyor 4 configured to feed the succession of bags B so they confront the filling station 3.

Preferably, the feed conveyor 4 is made in such a way as to move the bags B with intermittent motion.

Preferably, the feed conveyor 4 is made in such a way as to move the bags B with continuous motion but such as to place the bags B at the filling station 3 at periodic intervals.

The feed conveyor 4 comprises a band conveyor 4*a* and a cleated conveyor 4*b*.

The band conveyor 4*a* is configured to carry the bags B to the cleated conveyor 4*b*. The cleated conveyor 4*b* is configured to feed the succession of bags B to the filling station 3 and to set them apart by a predetermined spacing. More specifically, the cleated conveyor 4*b* is provided with suitable compartments 4*c*, each shaped in such a way as to contain a respective bag B. The cleated conveyor 4*b* extends between a first end and a second end. The first end is the one located in the proximity of the band conveyor 4*a*, while the second end is the one that confronts the filling station 3. In other words, the first end is an end for collecting the bags B and the second end is an end for depositing the bags B. Preferably, the band conveyor 4*a* and the cleated conveyor 4*b* are positioned perpendicularly to each other, as shown for example in the accompanying drawings.

Figure 2A:
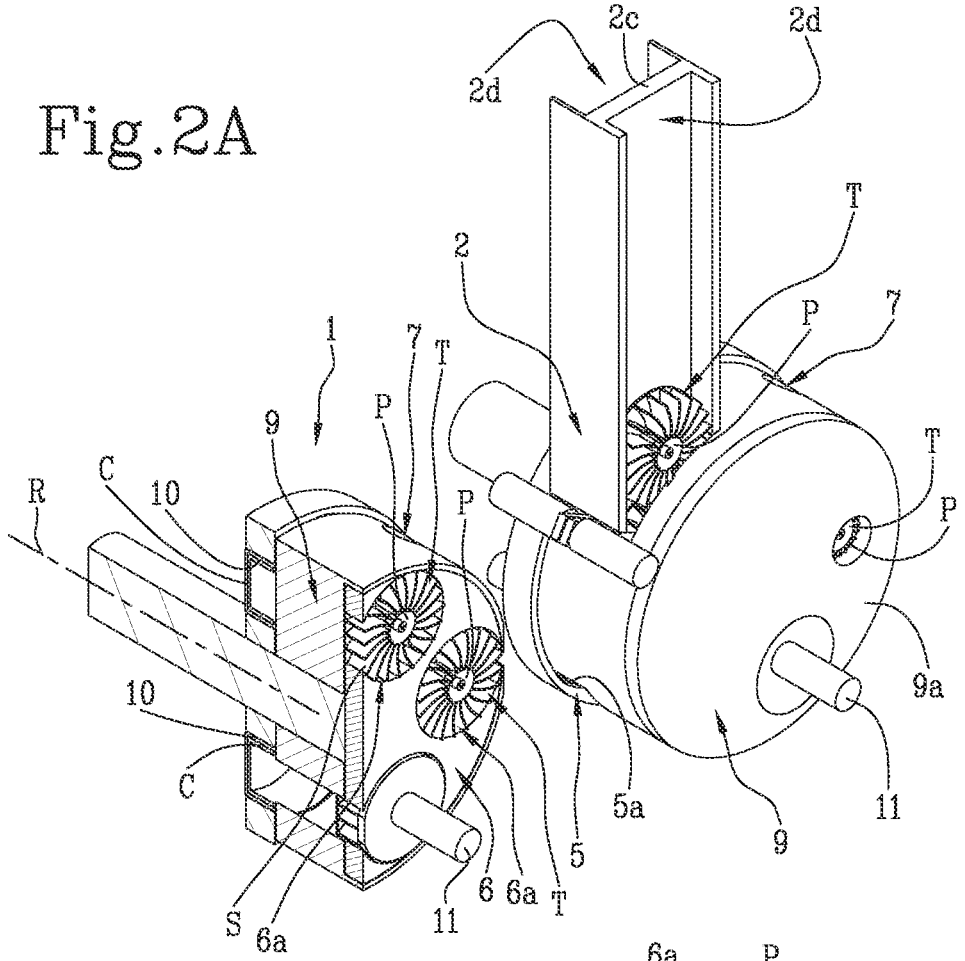
FIGS. 2A-2D are schematic representations of different views of a component of the device of FIG. 1.
Figure 2B:
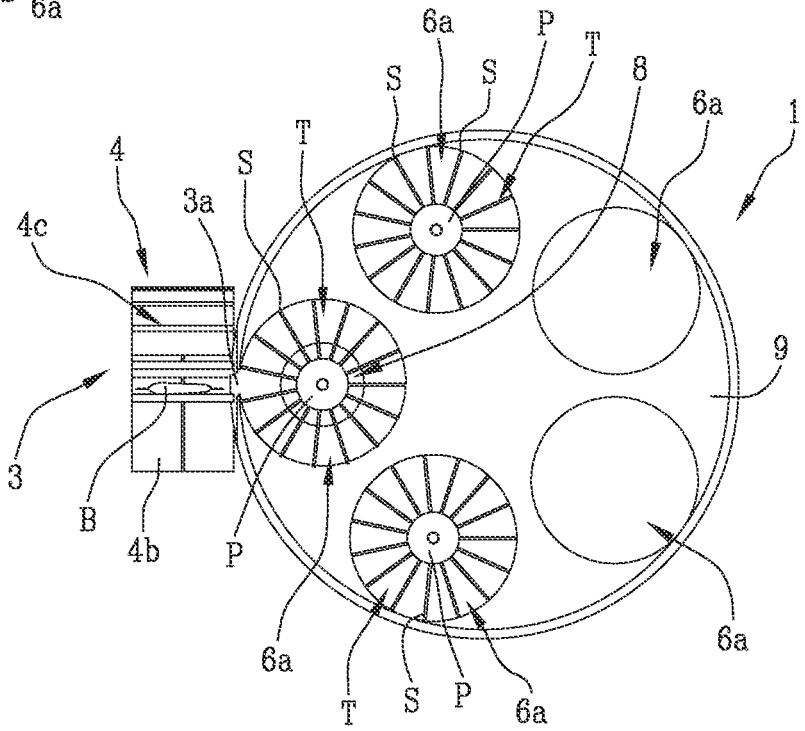
Figure 2C:
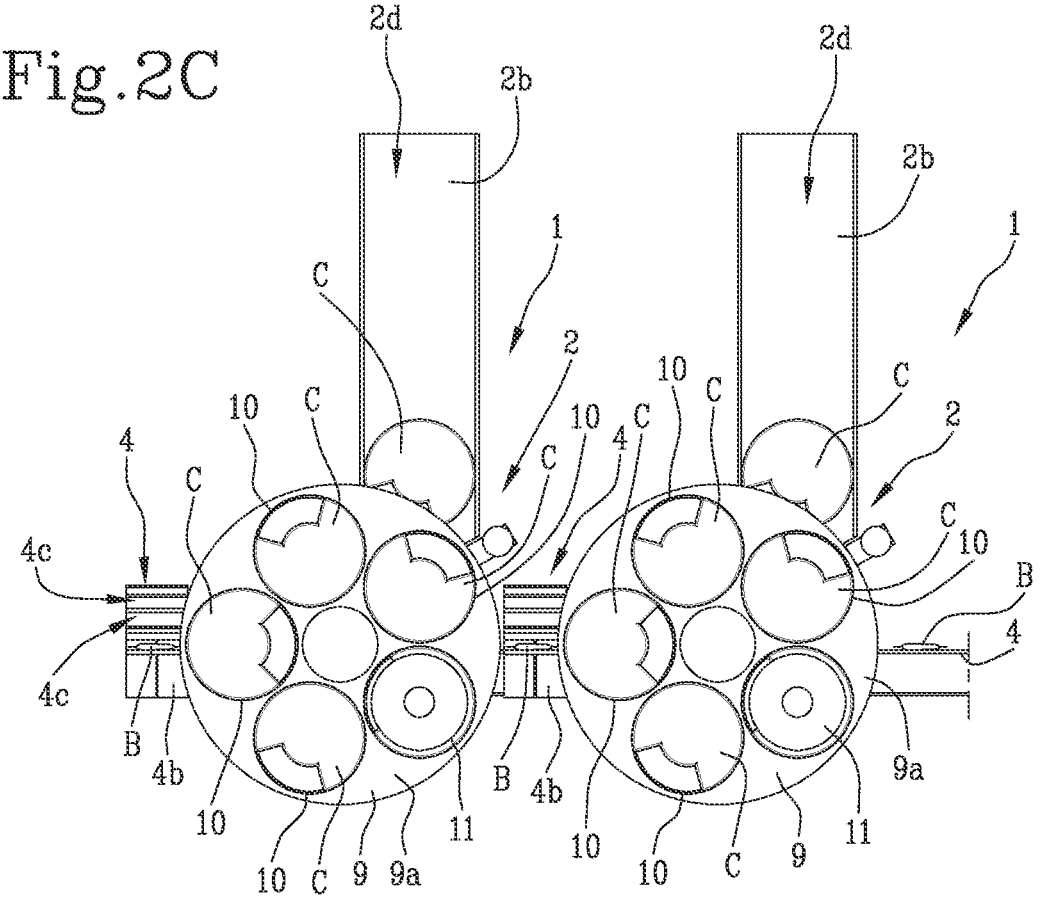
Figure 2D:
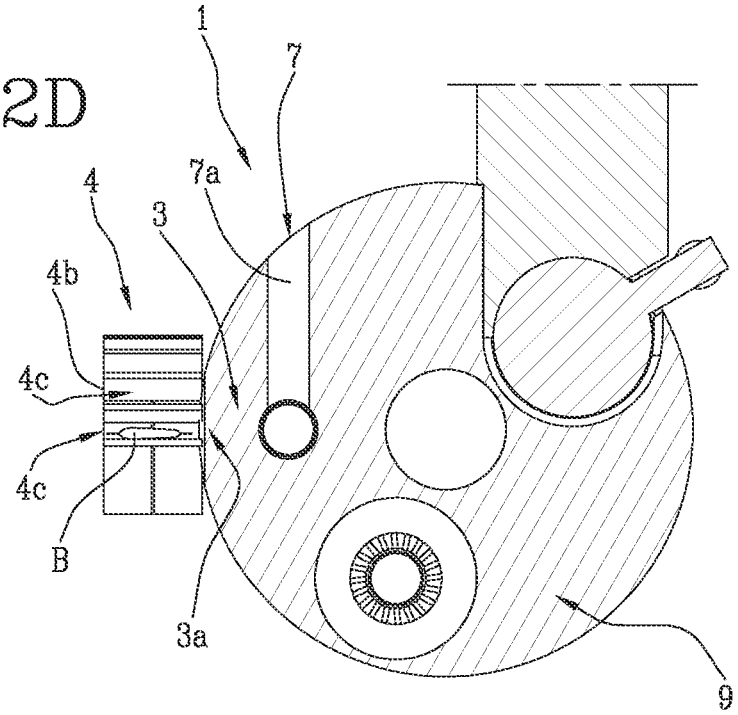
Figure 3A:
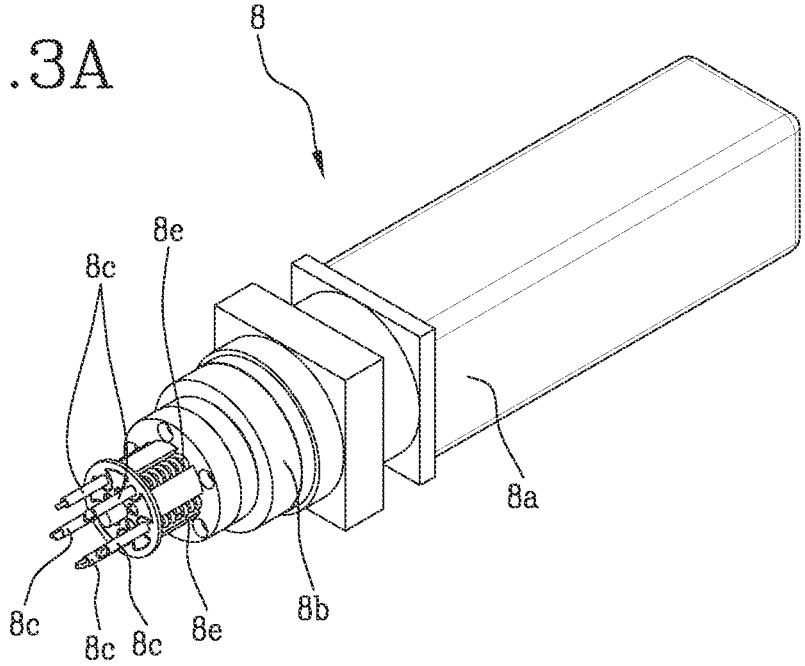
FIGS. 3A and 3B are schematic representations of another component of the device of FIG. 1.
Figure 3B:
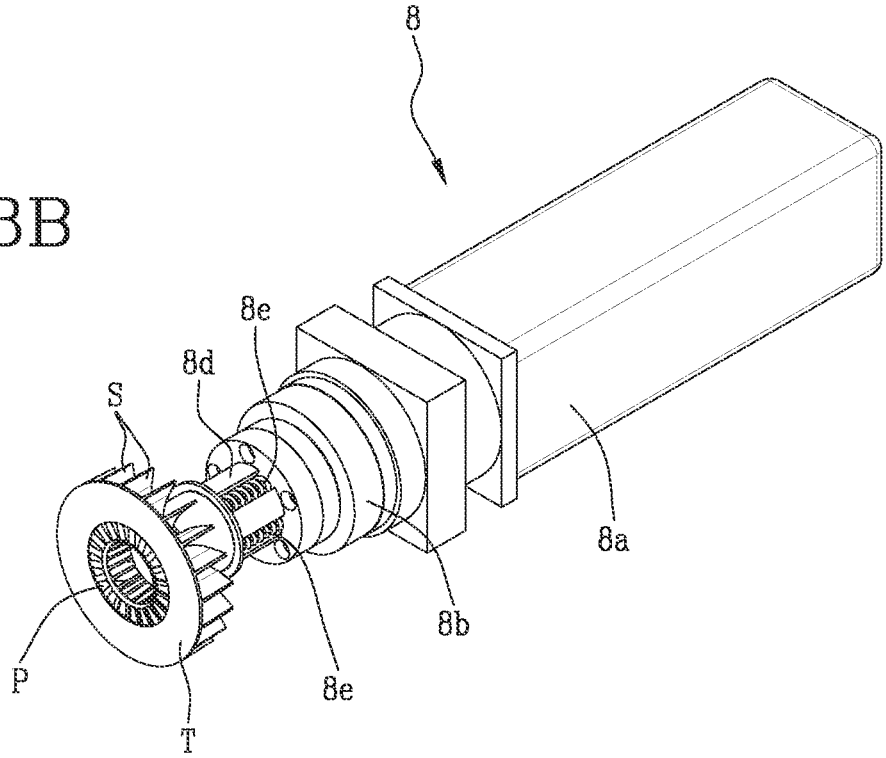

The device 1 also comprises a release station 5 (shown in FIG. 2A) configured for releasing at least the succession of inner frames T which are full of bags B.

The device 1 also comprises a conveyor 6 defining a feed line which passes through the infeed station 2, the filling station 3 and the release station 5. The conveyor 6 has at least one housing 6*a* configured to hold and move a respective inner frame T from the infeed station 2 to the release station 5 by way of the filling station 3. More specifically, the conveyor is configured to move the housing 6*a*, which is holding the respective inner frame T, from the infeed station 2 to the filling station 3, where it will remain until all the radial compartments of the inner frame T are full, and from the filling station 3 to the release station 5.

The at least one housing 6*a* of the conveyor 6 is circular in shape so as to accommodate the respective inner frame T. More specifically, the at least one housing 6*a* is shaped in such a way as to accommodate the respective inner frame T loosely and in a freely rotatable manner. In other words, the inner frame T is free to rotate inside the housing 6*a*.

The conveyor 6 has a succession of housings 6*a* located in sequence along the feed line. In the embodiment illustrated, the conveyor 6 is configured like a conveying wheel rotatable about a respective horizontal axis of rotation R. Thus, the housings 6*a* are distributed radially relative to the axis of rotation R and move along a feed line defined by the trajectory defined by the rotation around the axis of rotation R. Preferably, as shown for example in the accompanying drawings, the conveyor 6 comprises five housings 6*a* disposed radially around the axis of rotation R. A different number of housings is imaginable as a function of the production capacities required of the device 1.

The axis of rotation R of the conveying wheel is parallel to the central axes of the inner frames T disposed in the housings 6*a*. More specifically, the central axis of each inner frame T coincides with the central axis of the respective housing 6*a*. Therefore, the axis of rotation R of the conveyor 6 is parallel to the axes of the housings 6*a*. As a result, each bag B is inserted when it lies in a respective horizontal positioning plane, as describe below.

The device 1 also comprises suction means 7, located in the filling station 3. The suction means 7 are configured to apply pneumatic suction in the housing 6*a* of the conveyor 6 disposed in the filling station 3.

Preferably, the suction means 7 are made in the form of a suction channel 7*a* connected or connectable to a source of pneumatic suction (not illustrated). The suction means 7 are therefore configured to take air in, preferably intermittently, in such a way as to fill a bag into a respective radial compartment, as will become clearer as this description continues.

The device 1 also comprises rotation means 8 disposed in the filling station 3 and confronting the housing 6*a* of the conveyor 6 disposed in the filling station 3. The rotation means 8 are configured to set the inner frame T disposed in the housing 6*a* in rotation. More specifically, the rotation means 8 allow the inner frame T to rotate about the respective central axis so that successive radial compartments of the inner frame T each confront a respective bag B to be inserted in sequence.

Thus, the suction means 7 are configured to take air in in such a way as to insert the bag B into the respective radial compartment made to confront the bag B by the rotation means 8. In use, the suction means 7 work intermittently, taking air in when an empty radial compartment is confronting the bag B and not taking air in during the rotation of the inner frame T driven by the rotation means 8.

The suction means 7 and the rotation means 8 are positioned opposite each other relative to the housing 6*a* of the conveyor 6. More specifically, in the filling station 3, the suction means 7 and the rotation means 8 are aligned along the central axis of the inner frame T disposed in the housing 6*a*. That way, when the housing 6*a* is aligned correctly in the filling station 3, the rotation means 8 are able to set the respective inner frame T in rotation from a portion of the housing 6*a*, while the suction means 7 are able to generate a suction flow from the portion opposite to that where the rotation means 8 are.

In this regard, the suction channel 7*a* is preferably made up of one or more stretches which, in conjunction with the housing 6*a* disposed in the filling station 3, define a suction path. As shown in the accompanying drawings, the suction channel 7*a* is provided with a first portion that is perpendicular to a second portion whose axis of extension coincides with that of the housing 6*a* when the housing is in the filling station 3 (that is, with that of the respective inner frame T). Alternatively, the suction channel 7*a* may be made as a single duct whose axis of extension coincides with the axis of the housing 6*a*.

The rotation means 8 comprise a motor-driven shaft 8*a* whose axis of rotation is perpendicular to the feed line of the inner frames T (that is, the feed line of the housings 6*a*). More specifically, the motor-driven shaft 8*a* has an axis of rotation which is parallel to and coincident with the central axis of the inner frame T positioned in the filling station 3. In other words, the motor-driven shaft 8*a* has an axis of rotation which is parallel to and coincident with the axis of the housing 6*a* positioned in the filling station 3.

The motor-driven shaft 8*a* can be moved axially towards and away from the inner frame T positioned in the filling station 3. In other words, the motor-driven shaft 8*a* can be moved axially relative to the housing 6*a* positioned in the filling station 3 in such a way as to move into (or out of) the housing to interact with the inner frame T.

This axial movement allows the motor-driven shaft 8*a* to adopt a configuration of disengagement from, or engagement with, the inner frame T. More specifically, moving axially towards the inner frame T allows the motor-driven shaft 8*a* to adopt a configuration of engagement with the inner frame T and moving axially away from the inner frame T allows the motor-driven shaft 8*a* to adopt a configuration of disengagement from the inner frame T.

The accompanying drawings show a motor-driven shaft 8*a* having a head 8*b* provided with axial fingers 8*c*. The axial fingers 8*c* are configured to be inserted axially into corresponding radial compartments of the inner frame "T" disposed in the filling station 3. That way, the motor-driven shaft 8*a* (or rather, the axial fingers 8*c*) are able to set the inner frame T in rotation about is central axis.

In other words, the axial fingers 8*c* are configured to be inserted between the radial separators S in such a way as to come into contact with the radial separators as they rotate, pushing them to impart to them the rotation necessary to allow an empty radial compartment to confront a respective bag B.

The head 8*b* comprises a receiving body 8*d* which is rotatable as one with the motor-driven shaft 8*a*. The receiving body 8*d* is provided with holes into which the axial fingers 8*c* are slidably inserted. More specifically, the axial fingers 8*c* are slidably inserted under the action of respective elastic means 8*e* configured to keep the axial fingers 8*c* pressed towards the inner frame T disposed in the filling station 3. Preferably, the elastic means 8*e* are embodied in the form of springs. Alternatively, the elastic means 8*e* are embodied in other forms, suitable for applying an elastic pushing force on the axial fingers 8*c* to keep them pressed towards the inner frame T. That way, the axial fingers 8*c* can be inserted between the radial compartments even if they first come into direct contact with the radial separators S of the inner frame T itself.

The axial fingers 8*c* are distributed radially relative to the axis of extension of the motor-driven shaft 8*a*. In other words, the axial fingers 8*c* are parallel to the axis of extension of the motor-driven shaft 8*a* (hence parallel to the central axis of the inner frame T or of the housing 6*a*).

Preferably, and as shown in the accompanying drawings, the axial fingers 8*c* have a free end with a pointed shape—for example, with a V-shaped profile. This shape, combined with the elastic means 8*e*, allows the elastic means 8*c* to be inserted correctly into the radial compartments even if the tips of the axial fingers 8*c* themselves come into direct contact with the radial separators S. In this embodiment, the V shape of the free end of each of the axial fingers 8*c* allows the axial fingers 8*c* themselves to slide against the radial separators S and to be inserted properly between them. Preferably, also, the free ends of the axial fingers 8*c* have a transverse cross section, that is non-circular, specifically flattened, in shape.

The rotation means 8 may also comprise an electric stepping motor (not illustrated) to set the motor-driven shaft

8*a* in rotation. More specifically, the electric stepping motor allows the inner frame T to rotate intermittently by small angular values so that each empty radial compartment confronts a respective bag B with a high degree of angular precision.

As shown by way of example in the embodiment of FIG. 1, the device 1 also comprises a containing body 9 enclosing the conveyor 6 and defining an inlet opening 2*a* in the infeed station 2, a filler opening 3*a* in the filling station 3 and an outlet opening 5*a* in the release station 5.

In this embodiment, the suction channel 7*a* of the suction means 7 is made on the containing body 9 and leads into the filling station 3, specifically at the central axis of the inner frame T disposed in the housing in the filling station 3. Preferably, the containing body 9 has a pair of disc-shaped closing walls 9*a* parallel and opposite to each other and perpendicular to the central axis of the inner frame "T" transported by the conveyor 6.

The containing body 9 has, at the infeed station 2, an infeed channel 2*b* configured to feed a succession of inner frames T along a direction perpendicular to the respective central axes. The infeed channel 2*b* is parallel to a positioning plane of the feed line of the inner frames T. In other words, the infeed channel 2*b* is parallel to a positioning plane of the conveyor 6.

As shown in the accompanying drawings, the infeed station 2 is also configured to feed a succession of pairs, each defined by the inner frame T and a corresponding container body C. That way, each inner frame T and each corresponding container body C are made to advance in parallel along respective trajectories confronting each other.

The conveyor 6 is configured for advancing each inner frame T and each container body C along the feed line while keeping them in a mutually juxtaposed configuration at least until they reach the filling station.

Preferably, one of the disc-shaped walls 9*a* defines a series of housings 10 which accommodate the container bodies C. Preferably, the axis of rotation of the conveyor 6 also sets in rotation the disc-shaped wall 9*a* which carries the container bodies C. In other words, the inner frames T are set in rotation on one side of the containing body 9 and the container bodies C are set in rotation on the side opposite to that on which the inner frame T are carried.

The infeed channel 2*b* has a longitudinal separator 2*c* defining two feed half-channels 2*d* on opposite sides. The two half-channels 2*d* allow the inner frames T and the respective container bodies C to be advanced and fed into the containing body 9. Preferably, and as illustrated by way of example in the accompanying drawings, the infeed channel 2*b* is defined by a guide having the shape of (that is, a cross section in the shape of) an H.

Preferably, the infeed channel 2*b* is configured for gravity feeding the inner frames T and the container bodies C into the containing body 9.

Preferably, the device 1 further comprises packing means 11 disposed in the release station 5 and configured to insert each inner frame T, which is full of respective bags B, into the corresponding container body C.

Alternatively, the packing means 11 are disposed just upstream of the release station 5.

Advantageously, the device 1 allows filling the inner frames T quickly and extremely efficiently, thus reducing production times, with significant economic advantages.

This invention also has for an object a method for filling containers for bags B of smokeless tobacco, specifically tobacco of the snus type. The method can be implemented by a device 1 according to any one of the embodiments described in the foregoing.

The method comprises feeding a succession of bags B in proximity to the filling station 3.

Preferably, the step of feeding is carried out by a feed conveyor 4. The feed conveyor 4 is configured to feed a succession of individual bags B spaced from each other by a predetermined spacing so they confront the filling station 3.

The method also comprises feeding a succession of inner frames T. The step of feeding the inner frames T is carried out by means of an infeed channel 2*b*. Preferably, feeding is performed by gravity.

Preferably, the step of feeding may also be performed by feeding a succession of container bodies C defining a succession of pairs, each comprising an inner frame T and a corresponding container body C. This step of feeding, too, may be performed by gravity.

The method, at this point, comprises inserting an inner frame T into a housing 6*a* of the conveyor 6 and moving the housing provided with the inner frame along a feed line. More specifically, the method comprises moving the inner frame T from an infeed station 2 to a filling station 3. This movement is achieved, for example, by rotating the conveyor 6.

Once the inner frame T has been placed in the filling station 3, pneumatic suction is applied through suction means 7 disposed in the filling station 3. The pneumatic suction is applied in the housing 6*a* of the conveyor 6 in such a way as to fill a radial compartment of the inner frame T with a bag B.

This is followed by a step, performed by rotation means 8, of rotating the inner frame T disposed in the housing 6*a* about its central axis so that an empty radial compartment of the inner frame T confronts a respective bag B to be inserted.

Next, the method comprises repeating the steps of applying the pneumatic suction and of rotating until the radial compartments of the inner frame T are all full.

This is followed by a step of moving the housing 6*a*, with a full inner frame T in it, up to the release station 5 where the inner frame T is released.

The method may also comprise inserting the container body C into a respective housing 10 and then moving the housing 10 along the feed line from the infeed station 2 to a release station 5, keeping each inner frame T and each corresponding container body C in a mutually juxtaposed configuration at least until they reach the filling station 3. In other words, the method may comprise moving the container body C from the infeed station 2 to the filling station 3 where it remains until the inner frame T is filled before being moved to the release station 5.

Preferably, the method comprises inserting each inner frame T, which is full of respective bags B, into the corresponding container body C through packing means 11 disposed in the release station 5.

Alternatively, the method comprises inserting each inner frame T, which is full of respective bags B, into the corresponding container body C through packing means 11 disposed just upstream of the release station 5.

Advantageously, this invention is capable of overcoming the disadvantages of the prior art by providing a filling device 1 and method as described above.

Advantageously, this invention allows the containers to be filled quickly and precisely.

Furthermore, this invention allows preventing the bags B from being damaged and the tobacco they contain from spilling out into the containers themselves.

Still more advantageously, this invention allows improving production times compared to prior art devices and methods.

The invention claimed is:

1. A device for filling containers for bags of smokeless tobacco, each container comprising a body and an inner frame comprising radial separators defining a plurality of radial compartments, the device comprising:

an infeed station including an inlet opening and configured for feeding at least one succession of inner frames, wherein each inner frame has a central portion which extends around a respective central axis and a plurality of radial separators extending away from the central portion and defining a plurality of radial compartments which are angularly disposed around the central axis;

a filling station including a filler opening and configured to feed a succession of individual bags of smokeless tobacco to a respective inner frame;

a release station including an outlet opening and configured for releasing at least one succession of inner frames which are full of bags;

a conveyor defining a feed line which passes through the infeed station, the filling station and the release station and which has at least one housing configured to hold and move a respective inner frame from the infeed station to the release station by way of the filling station;

a suction device disposed in the filling station and configured to apply pneumatic suction in the at least one housing disposed in the filling station, the suction device including a suction channel connected or connectable to a source of the pneumatic suction;

a rotation device disposed in the filling station and confronting the at least one housing disposed in the filling station, the rotation device being configured to set the inner frame disposed in the at least one housing in rotation about the respective central axis so that successive radial compartments of the inner frame each confront a respective bag to be inserted in sequence, the rotation device including a motor-driven shaft.

2. The device according to claim 1, wherein the suction device and the rotation device are disposed in the filling station at opposite positions with respect to the at least one housing.

3. The device according to claim 2, wherein the suction device and the rotation device are disposed in the filling station at positions which are aligned along the central axis of the inner frame disposed in the at least one housing.

4. The device according to claim 1, wherein the at least one housing is circular in shape so as to house a respective inner frame in a freely rotatable manner.

5. The device according to claim 1, wherein the at least one housing includes a succession of housings disposed in sequence along the feed line.

6. The device according to claim 5, wherein the succession of housings disposed in sequence along the feed line are configured as a conveying wheel rotatable about an axis of rotation.

7. The device according to claim 6, wherein the axis of rotation of the conveying wheel is parallel to the central axes of the inner frames disposed in the housings.

8. The device according to claim 1, further comprising a containing body enclosing the conveyor and defining the inlet opening in the infeed station, the filler opening in the filling station and the outlet opening in the release station, and wherein the suction channel is made on the containing body and leads into the filling station.

9. The device according to claim 8, wherein the containing body has a pair of disc-shaped closing walls parallel and opposite to each other and perpendicular to the central axis of the inner frame transported by the conveyor.

10. The device according to claim 8, wherein the containing body has, at the infeed station, an infeed channel configured to feed a succession of inner frames along a direction perpendicular to the respective central axes and parallel to a positioning plane of the feed line.

11. The device according to claim 10, wherein the infeed station is configured to feed a succession of pairs defined by an inner frame and a corresponding container body in such a way that each inner frame and each corresponding container body are made to advance in parallel along respective trajectories running alongside each other, and wherein the conveyor is configured to make each inner frame and each corresponding container body advance along the feed line, keeping them in a mutually juxtaposed configuration at least until they reach the filling station.

12. The device according to claim 11, wherein the infeed channel has a longitudinal separator to define two opposite half-channels for feeding the inner frames and the respective container bodies, respectively.

13. The device according to claim 12, wherein the infeed channel is defined by a guide having an H-shaped cross section.

14. The device according to claim 11, further comprising a packing device disposed in the release station or upstream of the release station, and having a surface configured to insert each inner frame, which is full of respective bags, into the corresponding container body.

15. The device according to claim 8, wherein the suction channel leads into the filling station at the central axis of the inner frame disposed in the at least one housing in the filling station.

16. The device according to claim 1, wherein the motor-driven shaft has an axis of rotation perpendicular to the feed line, the motor-driven shaft being movable axially towards and away from the inner frame disposed in the filling station to adopt, respectively, an engaged configuration where it engages the inner frame and a disengaged configuration, where it is disengaged from the inner frame.

17. The device according to claim 16, wherein the motor-driven shaft includes a head equipped with axial fingers configured to be inserted axially into corresponding radial compartments of the inner frame disposed in the filling station to set the inner frame in rotation about its central axis.

18. The device according to claim 17, wherein the head comprises a receiving body, rotatable as one with the motor-driven shaft and provided with holes into which the axial fingers are slidably inserted under the action of respective springs configured to keep the axial fingers pressed towards the inner frame disposed in the filling station.

19. The device according to claim 16, wherein the rotation device further comprises an electric stepping motor to drive the motor-driven shaft in rotation.

20. The device according to claim 16, wherein the axis of rotation is parallel and coincident with the central axis of the inner frame disposed in the filling station.

21. The device according to claim 1, further comprising a feed conveyor, which is configured to feed a succession of individual bags spaced from each other by a predetermined spacing so the individual bags confront the filling station.

22. The device according to claim 21, wherein the feed conveyor comprises a band conveyor and a cleated conveyor.

23. A method for filling containers for bags of smokeless tobacco, comprising the following steps:

providing a device for filling containers for bags of smokeless tobacco, each container comprising a body and an inner frame comprising radial separators defining a plurality of radial compartments, the device comprising:

an infeed station including an inlet opening and configured for feeding at least one succession of inner frames, wherein each inner frame has a central portion which extends around a respective central axis and a plurality of radial separators extending away from the central portion and defining a plurality of radial compartments which are angularly disposed around the central axis;

a filling station including a filler opening and configured to feed a succession of individual bags of smokeless tobacco to a respective inner frame;

a release station including an outlet opening and configured for releasing at least one succession of inner frames which are full of bags;

a conveyor defining a feed line which passes through the infeed station, the filling station and the release station and which has at least one housing configured to hold and move a respective inner frame from the infeed station to the release station by way of the filling station;

a suction device disposed in the filling station and configured to apply pneumatic suction in the at least one housing disposed in the filling station, the suction device including a suction channel connected or connectable to a source of the pneumatic suction;

a rotation device disposed in the filling station and confronting the at least one housing disposed in the filling station, the rotation device being configured to set the inner frame disposed in the at least one housing in rotation about the respective central axis so that successive radial compartments of the inner frame each confront a respective bag to be inserted in sequence, the rotation device including a motor-driven shaft;

feeding a succession of the bags to the filling station;

feeding a succession of the inner frames into the infeed station, wherein each inner frame has a central portion which extends around a respective central axis and a plurality of radial separators extending away from the central portion and defining a plurality of radial compartments which are angularly disposed around the central axis;

inserting one of the inner frames into a housing of the at least one housing of the conveyor;

moving the housing provided with the inner frame along the feed line from the infeed station to the filling station;

applying pneumatic suction in the housing of the conveyor through the suction device disposed in the filling station, to fill a radial compartment of the inner frame with a bag;

through the rotation device, rotating the inner frame disposed in the housing about the respective central axis so that an empty radial compartment of the inner frame confronts a respective bag to be inserted;

repeating the steps of applying the pneumatic suction and of rotating until the radial compartments of the inner frame are all full of bags;

moving the housing, with a full inner frame in the housing, up to the release station;

releasing the inner frame which is full of bags.

24. The method according to claim 23, and further comprising the following steps:

feeding a succession of container bodies defining a succession of pairs defined by an inner frame and a corresponding container body;

inserting a container body into the respective housing of the conveyor;

moving the housing provided with the container body along the feed line from the infeed station to a release station, keeping each inner frame and each corresponding container body in a mutually juxtaposed configuration at least until reaching the filling station;

inserting each inner frame, which is full of respective bags, into the corresponding container body through a packing device disposed in the release station or upstream of the release station.

25. The method according to claim 23, wherein the step of feeding the succession of bags is carried out by a feed conveyor configured to feed a succession of individual bags spaced from each other by a predetermined spacing so they confront the filling station.

* * * * *